US006418764B1

(12) United States Patent
Lerchner

(10) Patent No.: US 6,418,764 B1
(45) Date of Patent: Jul. 16, 2002

(54) DRIVE APPARATUS FOR A LOCK WITH LOCK CYLINDER

(75) Inventor: Leonhard Lerchner, Salzburg (AT)

(73) Assignee: KESO GmbH, Salzburg (AT)

( * ) Notice: Subject to any disclaimer, the term of this patent is extended or adjusted under 35 U.S.C. 154(b) by 0 days.

(21) Appl. No.: 09/403,731

(22) PCT Filed: Feb. 18, 1999

(86) PCT No.: PCT/EP99/01016

§ 371 (c)(1),
(2), (4) Date: Oct. 22, 1999

(87) PCT Pub. No.: WO99/42686

PCT Pub. Date: Aug. 26, 1999

(30) Foreign Application Priority Data

Feb. 23, 1998 (DE) ..... 198 07 553

(51) Int. Cl.[7] ..... E05B 47/00
(52) U.S. Cl. ..... 70/279.1; 70/283
(58) Field of Search ..... 70/277–283

(56) References Cited

U.S. PATENT DOCUMENTS 5,014,030 A * 5/1991 Aston ..... 70/283 X
5,113,675 A * 5/1992 Uyeda ..... 70/283 X
5,404,737 A * 4/1995 Hotzl ..... 70/279
5,475,996 A * 12/1995 Chen ..... 70/279
5,541,581 A * 7/1996 Trent ..... 70/283 X
5,694,798 A * 12/1997 Nunez et al. ..... 70/283
5,946,955 A * 9/1999 Suggs et al. ..... 70/278 X
5,960,656 A * 10/1999 Yao ..... 70/279.1 X
5,974,912 A * 11/1999 Cheng et al. ..... 70/279.1 X
6,012,310 A * 1/2000 Hsiao ..... 70/278.2
6,038,896 A * 3/2000 Chamberlain et al. ..... 70/279.1
6,089,058 A * 7/2000 Elpern et al. ..... 70/279.1
6,145,353 A * 11/2000 Doucet ..... 70/277

FOREIGN PATENT DOCUMENTS

| | | | |
|---|---|---|---|
| CH | 669 425 | 3/1989 | |
| DE | 33 10 822 | 10/1984 | |
| DE | G 92 07 789.7 | 10/1992 | |
| DE | 297 03 559 | 6/1997 | |
| DE | 196 01 424 | 7/1997 | |
| FR | 2485128 | * 12/1981 | ..... 70/279.1 |
| FR | 2596096 | * 9/1987 | ..... 70/279.1 |
| GB | 2262770 | * 6/1993 | ..... 70/283 |
| WO | 84/03909 | * 10/1984 | ..... 70/279.1 |
| WO | 96/07807 | 3/1996 | |

* cited by examiner

*Primary Examiner*—Suzanne Dino Barrett
(74) *Attorney, Agent, or Firm*—Flynn, Thiel, Boutell & Tanis, P.C.

(57) ABSTRACT

For manual and motor operation of a locking cylinder a drive apparatus in the form of an escutcheon is provided on a door. The drive apparatus has a driveshaft for transmitting rotation to the locking cylinder, a turning handle for manual rotation of the driveshaft and a gear motor disposed in the turning handle for motor rotation of the driveshaft. A driving toothed wheel is disposed on the driveshaft so as to rotate in unison, being connected with the turning handle so as to transmit torque. The gear motor is adapted to be coupled with the escutcheon so as to rotate in unison and with the driving toothed wheel by a coupling when current is supplied.

22 Claims, 2 Drawing Sheets

DRIVE APPARATUS FOR A LOCK WITH LOCK CYLINDER

FIELD OF THE INVENTION

This invention relates to a drive apparatus for motor and manual operation of a lock or locking cylinder.

BACKGROUND OF THE INVENTION

A lock drive is known from DE 196 01 424 A1. The gear motor is connected with the turning handle so as to rotate in unison. To supply power to the motor, rubbing contacts are provided. The gear is formed by an epicyclic gear disposed coaxially to the motor and the driveshaft. In order to permit motor rotation of the driveshaft, the gear motor is connected with the escutcheon by an electromagnetic device so as to rotate in unison.

The known apparatus requires a lot of space due to its large axial length, the electromagnetic locking device and the like. Its reliability also leaves something to be desired. For example the rubbing contacts can soil easily.

CH 669 425 A5 discloses a motor drive for a cylinder lock which is operable additionally by hand using a key. In this hand operation the motor drive is coupled via a coupling.

DE 33 10 822 C2 describes the formation of a toothed gear as a coupling, the coupling/uncoupling being effected with axially displaceable coupling wheel 21. Further, DE 297 03 559 U1 describes an electromechanical coupling between the operating knob, and the lock.

WO 96/07807 A1 discloses the principle of coupling from the turning handle to the adjusting mechanism via an internal toothing.

SUMMARY OF THE INVENTION

This invention is directed to a lock drive apparatus which works reliably while requiring little space and having a simple structure.

According to the invention, a gear motor is connected with the escutcheon so as to rotate in unison. Thus, no rubbing contacts or the like are necessary for energizing the motor.

The rotation of the turning handle (e.g. knob) rotatably mounted on the escutcheon is transmitted to the driveshaft by a driving toothed wheel according to the invention. The permanent torque transmission from the turning handle to the driving toothed wheel can be effected e.g. by an internal toothing on the turning handle which meshes with the driving toothed wheel.

By the driving toothed wheel the gear motor is at the same time connected with the driveshaft according to the invention in order to permit motor operation of the lock or locking cylinder. For this purpose, a coupling is provided which connects the gear motor with the driving toothed wheel when current is supplied.

In the currentless, i.e. uncoupled, state of the gear motor, the turning handle can be operated manually with low expenditure of force. Since the turning handle is always connected with the driving toothed wheel so as to transmit torque, the turning handle corotates upon motor operation of the lock or locking cylinder.

Opening of the lock with the gear motor can be started by an access control system. One can also provide a switch, e.g. a push button, on the escutcheon for operating the gear motor, or the gear motor can be operated by an external switch. The inventive drive apparatus opens the lock via the turning handle and draws the latch of the lock, if any. Control of the gear motor is performed by control electronics disposed externally on the escutcheon.

For detecting the rotary position of the drive-shaft, a position detecting device is provided which is connected with the driveshaft or driving toothed wheel so as to transmit torque. The position detecting device can be used to monitor the revolutions of the lock. Closing of the lock is effected automatically by the control electronics, depending on the adjusted parameters and the state of the position detecting device. Further sensors for position detection can also be provided, for example sensors which operate the gear motor for closing as soon as the door has fallen back into the frame.

The rotation axis of the turning handle is offset from the driveshaft, as are the motor shaft of the gear motor and at least the driven shaft of the gear. This eccentric, asymmetrical arrangement of the gear motor and turning handle makes it possible according to the invention to use a simply constructed motor gear with a short overall length and thus an accordingly short turning handle which receives the drive train comprising motor, gear and coupling.

The escutcheon preferably consists of a base plate and a drive receiving means to which the drive train comprising motor, gear and coupling is fastened. The drive receiving means, which is disposed in a recess of the base plate, can be assembled in different rotary positions relative to the base plate. This makes it possible to dispose the turning handle on the door leaf in an optimum position.

The coupling between the gear motor and the driving toothed wheel can be effected by an electromagnet or, alternatively, by operation of the gear motor.

In the case of electromagnetic coupling, one provides a coupling toothed wheel axially displaceable by an electromagnet and engaging, in the coupled position, the driving toothed wheel and a gear wheel rotating in unison on the driven shaft of the gear of the gear motor. In the uncoupled state with the electromagnet unenergized, however, the coupling toothed wheel is disengaged from the driving toothed wheel and/or the gear wheel. For this purpose the coupling toothed wheel can be spring-loaded to the uncoupled position.

If the coupling is operable by operation of the gear motor, one can provide an axially displaceable coupling toothed wheel on the driven shaft of the gear so as to rotate in unison, said wheel engaging the driving toothed wheel in the coupled position and being disengaged therefrom in the uncoupled position. In this embodiment the coupling toothed wheel is also spring-loaded to the uncoupled position.

In the case of mechanical coupling by operation of the gear motor, the axial displacement of the coupling toothed wheel can be effected by a dog on the driven shaft of the gear or the coupling toothed wheel and an oblique guide or sliding surface for the dog on the coupling toothed wheel or driven shaft of the gear. When the energizing of the gear motor is interrupted this causes automatic, currentless uncoupling of the gear motor from the driving toothed wheel since the uncoupling spring pushes the coupling toothed wheel back to its starting position. If no automatic uncoupling by the uncoupling spring is effected, uncoupling is effected at the latest by manual motion of the turning handle.

To prevent the gear motor from being damaged when hitting a stop in left- or right-hand motion one can provide a starting and stop shock absorber, for example a torsion spring, on one of the shafts between motor shaft and driveshaft.

BRIEF DESCRIPTION OF THE DRAWINGS

In the following description, several embodiments of the inventive drive apparatus are explained in more detail by way of example with reference to the drawing, in which.

DETAILED DESCRIPTION

Figure 2:
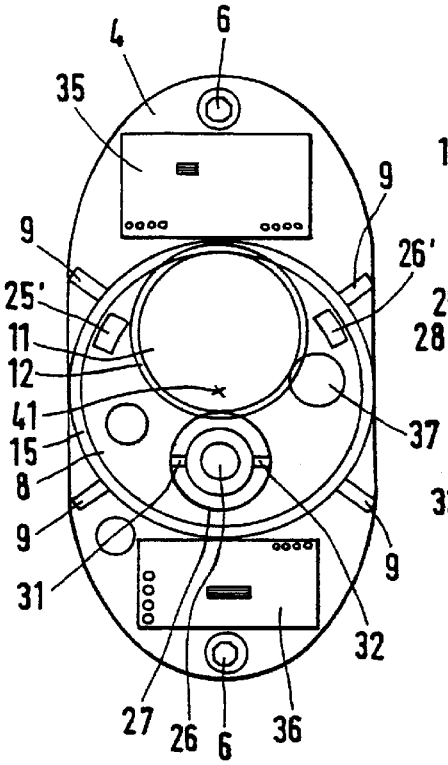
FIG. 2 shows a section along line 2—2 of FIG. 1.
Figure 1:
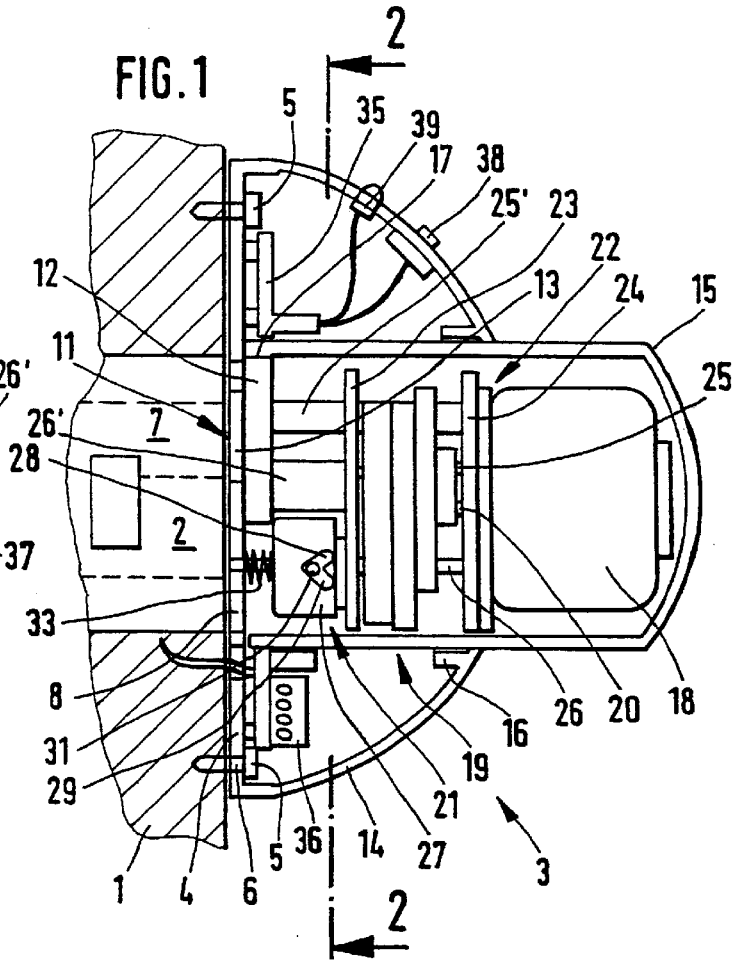
FIG. 1 shows a longitudinal section through a first embodiment of the apparatus.

According to FIGS. 1 and 2, a drive apparatus 3 for manual and motor operation of lock 2 is fastened to door 1 with cylinder lock 2 is shown.

Drive apparatus 3 has base plate 4 fastened to door 1 by means of screws 5 in mounting bores 6. In the area of schematically shown cylinder 7 of cylinder lock 2, base plate 4 has a circular recess in which plate-shaped drive receiving means 8 is fastened with fixing means 9.

Driveshaft 11 extends through drive receiving means 8 and is connected with cylinder 7 so as to rotate in unison. On driveshaft 11 driving toothed wheel 12 is disposed so as to rotate in unison. For connecting driveshaft 11 with driving toothed wheel 12 so as to rotate in unison, coupling 13 is provided. Coupling 13 serves to connect cylinders 7 of different constructions and sizes with driving toothed wheel 12.

Fastened to base plate 4 is housing 14 which has an opening coaxial with drive receiving means 8. Rotatably disposed in said opening is turning handle 15 in the form of a knob, which is e.g. mounted pivotally on housing 14 at 16.

Turning handle 15 has internal toothing 17 which engages driving toothed wheel 12. Handle 15 is rotatable around rotation axis 41 which is offset parallel to driveshaft 11.

Base plate 4 thus serves at the same time as a mounting plate on cylinder 7 or on the armature or on door 1.

Disposed in turning handle 15 is the drive train comprising electric motor 18, reduction gear 19 and coupling 21 in the stated order in the direction of lock 2 and driving toothed wheel 12.

Motor 18, gear 19 and coupling 21 are fastened to drive holding device 22 consisting of two plate-shaped carriers 23, 24 connected with drive receiving means 8 by bars 25' and 26'.

Motor 18 is flanged to carrier 23. Shafts 25, 26 of toothed gear 19 are mounted on carriers 23, 24, and driven shaft 26 of gear 19 also on drive receiving means 8. Motor shaft 20 is offset parallel to driveshaft 11.

Coupling toothed wheel 27 of coupling 21 is disposed in axially displaceable fashion on driven shaft 26 of gear 19 between carrier 24 and drive receiving means 8. Coupling toothed wheel 27 is disengaged from driving toothed wheel 12 in the position shown in FIG. 1, i.e. coupling 21 is uncoupled.

For axial displacement upon a connection ensuring rotation in unison with driven shaft 26, coupling toothed wheel 27 has two oblique guides 28, 29 forming a V, for example two such V-shaped guides 28, 29 on opposite sides. Dog pins 31, 32 fastened to driven shaft 26 engage V-shaped guides 28, 29, one on each side.

Guides 28, 29 and dogs 31, 32 form a connecting link guide which, independently of the direction of rotation of driven shaft 26, leads upon operation of motor 18 to axial displacement of coupling toothed wheel 27 away from the motor-side end of driven shaft 26 to the armature-side end thereof and thus to engagement of coupling toothed wheel 27 with driving toothed wheel 12, i.e. to coupling of gear motor 18, 19 with driveshaft 11.

Coupling toothed wheel 27 is loaded by spring 33 to the uncoupled position so that coupling 21 is disengaged when motor 18 is unenergized. When gear motor 18, 19 is disengaged, lock 2 can therefore be operated by rotation of turning handle 15.

That is, when the energizing of motor 18 is interrupted this causes automatic currentless uncoupling of coupling toothed wheel 27 from driving toothed wheel 12 since uncoupling spring brings coupling toothed wheel 33 27 back to the starting position.

Control electronics boards 35, 36 are fastened to base plate 4 on both opposite sides of drive receiving means 8.

For position detection of the rotary position of driveshaft 11 and thus of cylinder 7 a position detecting device is provided. This device can be pinion 37 meshing with driving toothed wheel 12 and operating e.g. a rotary rheostat.

Further, provided on housing 14 are switch or push button 38 for operating gear motor 18, 19 to open door 1, and optical display device 39, e.g. a LED, for indicating the closed position of lock 2.

For mounting drive apparatus 3, one first fastens base plate 4 to door 1. One then fastens drive receiving means 8 with the drive train already assembled thereon comprising motor 18, gear 19 and coupling 21 to base plate 4 with fixing means 9, and slips driving toothed wheel 12 on driveshaft 11 with coupling 13. Then, one places turning handle 15 on drive train 18, 19, 21 and fastens it to housing 14.

According to FIG. 2, driveshaft 11, rotation axis 41 of turning handle 15 and driven shaft 11 are disposed in a perpendicular.

Figure 3:
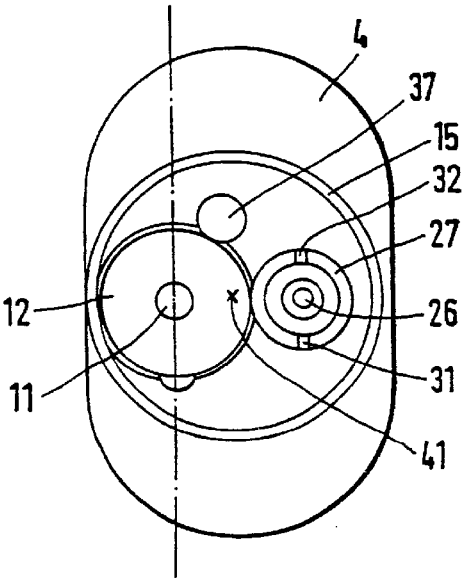
FIGS. 3 and 4 show views corresponding to FIG. 2 but with the cylinder driveshaft disposed on the left and right beside the rotation axis of the handle.
Figure 4:
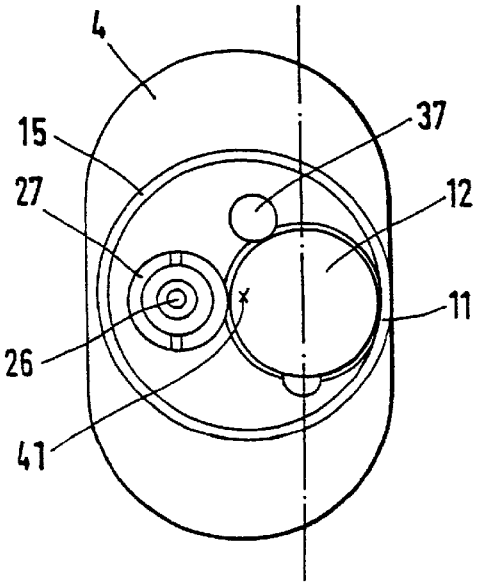

According to FIGS. 3 and 4, however, turning handle 15 can be shifted on door 1 to the left or right (or downward) of cylinder 7. For this purpose one need only rotate drive receiving means 8 around axis 41 by +90° or −90° (or 180°) and fasten it to base plate 14 in the thus offset rotary position. Turning handle 15 can thus be disposed on door 1 in the optimum position.

Figure 5:
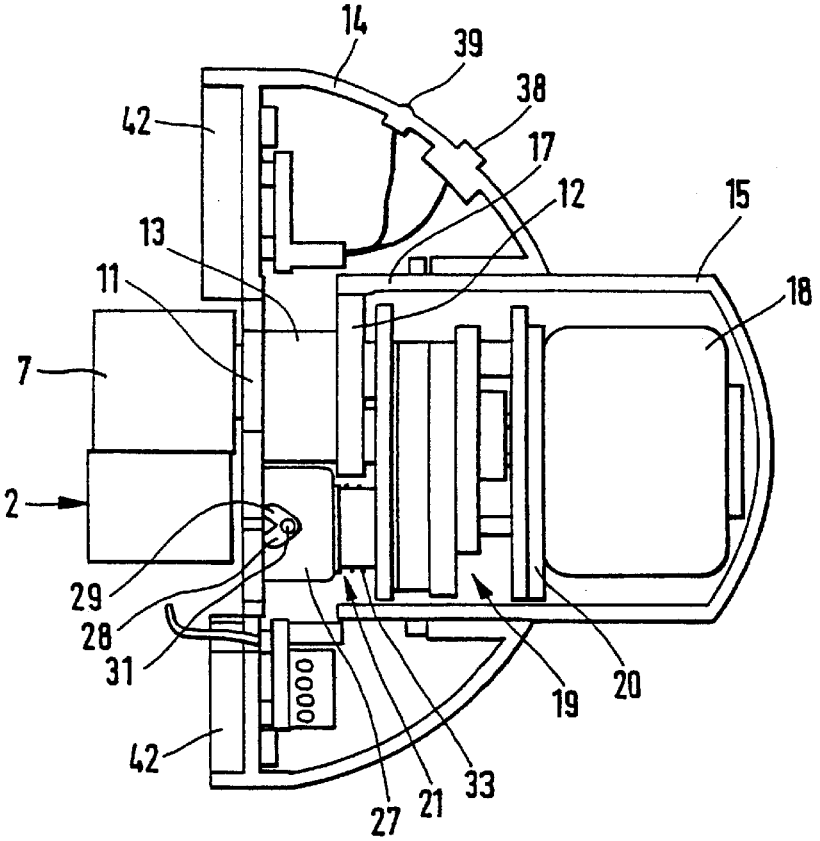
FIG. 5 shows a longitudinal section through a second embodiment of the apparatus.

The embodiment according to FIG. 5 differs from that according to FIGS. 1 and 2 substantially in that coupling toothed wheel 27 is disposed in the shown uncoupled position on driven shaft 26 not on the motor side but on the armature side, i.e. on drive receiving means 8, and uncoupling spring 33 is disposed between carrier 24 and coupling toothed wheel 27. This permits coupling 13 to be formed longer, making it accordingly more adaptable to different cylinder locks 2.

Further, supporting or height compensation parts 42 are provided on base plate 4 according to FIG. 5 in order to adapt the distance of driveshaft 14 from base plate 4 if locking cylinder 7 juts out.

Figure 6:
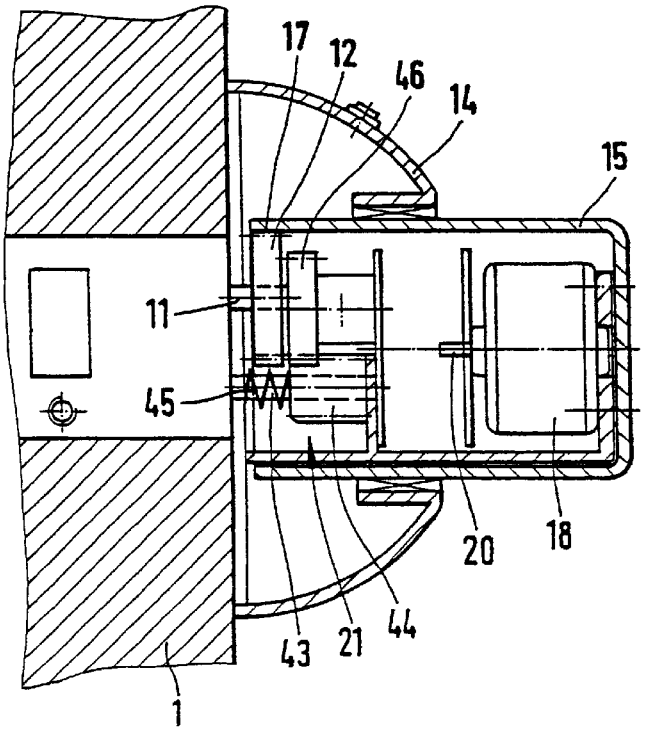
FIG. 6 shows a longitudinal section through a third embodiment of the apparatus.

The embodiment according to FIG. 6 differs from those according to FIGS. 1 and 2 or FIG. 5 substantially in that coupling 21 is formed as an electromagnetic coupling. For this purpose, coupling toothed wheel 44 axially displaceable with an electromagnet (not shown) is disposed on shaft 43, engaging in the coupled position driving toothed wheel 12 and gear wheel 46 on the driven shaft of the gear (not shown in FIG. 6) of motor 18, and being disengaged in the uncoupled position shown in FIG. 6 from driving toothed wheel 12, said coupling toothed wheel 46 also being spring-loaded to the uncoupled position with uncoupling spring 45.

What is claimed is:

1. A drive apparatus for a lock, said drive apparatus comprising: an escutcheon; a drive shaft rotatably fitted to said escutcheon for transmitting rotational force to said lock or a locking cylinder within said lock; a turning handle rotatable relative to said escutcheon; and a gear motor disposed in said turning handle, said gear motor having an output shaft, wherein:

a first toothed wheel is disposed on said drive shaft and is positioned to engage said turning handle so as transmit rotational movement of said turning handle to said drive shaft so that said drive shaft rotates;

said gear motor is secured to said escutcheon so as to rotate in unison with said escutcheon;

a coupler is provided for selectively coupling said gear motor output shaft to said first toothed wheel when a current is applied to said gear motor to actuate said gear motor.

2. The drive apparatus of claim 1, wherein: said turning handle is formed with inwardly directed teeth that are positioned to engage said first toothed wheel so as to transfer rotational movement of said turning handle to said first toothed wheel.

3. The drive apparatus of claim 1, wherein:

said drive shaft has a longitudinal axis; and said gear motor output shaft has a longitudinal axis, the longitudinal axis of said gear motor output shaft being offset from the longitudinal axis of said drive shaft.

4. The drive apparatus of claim 3, wherein:

said escutcheon comprises a base plate and a drive receiving means, wherein said drive receiving means is configured to be fastened to said base plate in a plurality of different rotary positions; and said gear motor is attached to said drive receiving means.

5. The drive apparatus of claim 1, wherein:

said drive shaft has a longitudinal axis; and said turning handle has a rotational axis about which said turning handle rotates and, the rotational axis of said turning handle is offset from the longitudinal axis of said drive shaft.

6. The drive apparatus of claim 5, wherein:

said escutcheon comprises a base plate and a drive receiving means, wherein said drive receiving means is configured to be fastened to said base plate in a plurality of different rotary positions; and said gear motor is attached to said drive receiving means.

7. The drive apparatus of claim 1, wherein:

a gear wheel is connected to said output shut of said gear motor and is driven by said output shaft; and said coupler includes second toothed wheel that is axially displaceable so as to have a coupled position wherein said second tooth wheel engages both said first toothed wheel and said gear wheel so as to transfer rotational movement from said gear motor to said first toothed wheel and an uncoupled position in which said second toothed wheel is disengaged from said first toothed wheel or said gear wheel.

8. The drive apparatus of claim 7, wherein said second toothed wheel is axially displaceable in response to application of an electromagnet force to said second toothed wheel.

9. The drive apparatus of claim 1, wherein said coupler includes an axially displaceable second toothed wheel, said second toothed wheel being attached to a driven shaft that is rotated by said gear motor, and said second toothed wheel has a coupled position in which said second toothed wheel engages the first toothed wheel and an uncoupled position in which said second toothed wheel is disengaged from said first toothed wheel.

10. The drive apparatus of claim 9, wherein:

one of said second toothed wheel or said driven shaft to which said second toothed wheel is attached has a dog; and the other of said driven shaft or said second toothed wheel is provided with a guide to which said dog is engaged so that rotation of said driven shaft results in axial displacement of said second toothed wheel.

11. The drive apparatus of claim 9, wherein:

said coupler is configured so that, when said second toothed wheel is in the uncoupled position, said second toothed wheel is position towards said escutcheon and, when said second toothed wheel is in the coupled position, said second tooth wheel is positioned towards said gear motor.

12. The drive apparatus of claim 9, wherein said second toothed wheel is normally biased into the uncoupled position by a spring that extends between a static surface of said drive apparatus and said second toothed wheel.

13. The drive apparatus of claim 1, further including a coupler extending between said drive shaft and said first toothed wheel for connecting said drive shaft and said first toothed wheel.

14. The drive apparatus of claim 4, further including control electronics for regulating said gear motor, said control electronics being mounted to said base plate adjacent one side of said drive receiving means.

15. The drive apparatus according to claim 1, further including a sensor connected to said drive shaft for generating a signal representative of a rotatary position of said drive shaft, said sensor including a member that is connected to said drive shaft to receive rotational movement of said drive shaft.

16. The drive apparatus according to claim 1, further including a housing wherein, said turning handle is rotatably fitted in said housing.

17. The drive apparatus according to claim 16, wherein at least one of a switch for operating said gear motor or an optical device connected to said lock for indicating the state of said lock is mounted to said housing.

18. A lock assembly, said lock assembly including:

a rotatable locking cylinder; and a drive assembly, said drive assembly including:

an escutcheon;

a drive shaft rotatably fitted to said escutcheon, said drive shaft being connected to said locking cylinder so as to transfer rotational motion to said locking cylinder;

a first gear attached to said drive shaft;

a handle rotatably fitted relative to said escutcheon, said handle having a gear member positioned to engage said first gear so that rotation of said handle results in rotation of said drive shaft;

a motor having an output shaft and disposed in said handle, wherein said motor is attached to a section of said escutcheon so as to rotate in unison with the section of said escutcheon; and a coupling assembly comprising: a second gear that is fitted to an axle so as to be displaceable along said axle and wherein said first gear, said second gear and said motor are arranged so that said second gear has a coupled position on said axle wherein said second gear engages both said motor output shaft and said first gear to transfer rotational motion from said motor output shaft to said drive shaft and an uncoupled position wherein said second gear is disconnected from one of said motor output shaft or said first gear; and a displacement assembly for moving said second gear between the coupled position and the uncoupled position.

19. The lock assembly of claim 18, wherein:

said coupling assembly further includes a third gear for receiving rotational movement from said motor output shaft; and when said second gear is in the coupled position, said second gear is positioned to engage both said first gear and said third gear, and when said second gear is in the uncoupled position, said second gear is disengaged from at least one of said first gear or said third gear.

20. The lock assembly of claim 18, wherein:

said axle to which said second gear is attached is a rotating shaft that is coupled to said motor output shaft to receive rotational motion from said motor output shaft; and said second gear receives from said axle to which said second gear is attached the rotational motion of said motor output shaft and, when said second gear is in the coupled position, said second gear transfers the rotational motion to said first gear.

21. The lock assembly of claim 18, wherein said coupling assembly further includes a biasing member connected to said second gear for normally holding said second gear in the uncoupled position.

22. The lock assembly of claim 18, wherein said second gear is displaceable in response to application of an electromagnetic force.

* * * * *